US006745522B2

(12) United States Patent
Germain

(10) Patent No.: US 6,745,522 B2
(45) Date of Patent: Jun. 8, 2004

(54) TELESCOPING HURRICANE SHUTTERS

(76) Inventor: Craig D. Germain, 25 Spanish Pointe, Hilton Head Island, SC (US) 29926

( * ) Notice: Subject to any disclaimer, the term of this patent is extended or adjusted under 35 U.S.C. 154(b) by 0 days.

(21) Appl. No.: 09/891,395

(22) Filed: Jun. 27, 2001

(65) Prior Publication Data

US 2003/0000160 A1 Jan. 2, 2003

(51) Int. Cl.[7] ..... E06B 7/08

(52) U.S. Cl. ..... 52/202; 52/203; 52/67

(58) Field of Search ..... 52/202, 789.1, 52/203, DIG. 12, 656.5, 788, 67, 473; 49/61, 464, 463, 57, 62, 227

(56) References Cited

U.S. PATENT DOCUMENTS 3,430,676 A * 3/1969 Aberg ..... 160/202
4,072,179 A * 2/1978 Naito ..... 160/197
4,251,966 A * 2/1981 Foltman ..... 52/309.1
4,333,271 A * 6/1982 DePaolo et al. ..... 49/464
4,562,666 A * 1/1986 Young, III ..... 49/463
4,685,261 A * 8/1987 Seaquist ..... 49/463
4,858,400 A * 8/1989 Foyt ..... 52/98
4,931,340 A * 6/1990 Baba et al. ..... 108/51.11
5,335,452 A * 8/1994 Taylor ..... 49/463
5,345,716 A * 9/1994 Caplan ..... 49/464
5,426,893 A * 6/1995 Hoffman ..... 49/464
D361,843 S * 8/1995 Pangborn ..... D25/47
5,457,921 A * 10/1995 Kostrzecha ..... 52/202
5,540,018 A * 7/1996 Biggers ..... 49/464
5,579,615 A * 12/1996 Hoffman ..... 49/464
5,596,849 A * 1/1997 Hill ..... 49/57
5,620,037 A * 4/1997 Apostolo ..... 160/118
5,651,221 A * 7/1997 Golen ..... 49/464
5,673,883 A * 10/1997 Figueroa, Jr. ..... 248/200.1
5,852,903 A * 12/1998 Astrizky ..... 49/63
5,855,099 A * 1/1999 Hoffman ..... 49/57
5,911,660 A * 6/1999 Watson ..... 49/464
5,918,430 A * 7/1999 Rowland ..... 244/129.3
5,996,292 A * 12/1999 Hill et al. ..... 49/57
6,079,168 A * 6/2000 Shaver ..... 49/464
6,189,264 B1 * 2/2001 DiVeroli ..... 160/215
6,219,978 B1 * 4/2001 Wood ..... 292/149
6,378,262 B1 * 4/2002 Mercadante ..... 52/473
6,393,777 B1 * 5/2002 Renfrow ..... 248/475.1

* cited by examiner

*Primary Examiner*—Carl D. Friedman
*Assistant Examiner*—Basil Katcheves
(74) *Attorney, Agent, or Firm*—Oliff & Berridge, PLC

(57) ABSTRACT

Telescoping hurricane shutters protect a window during a storm but eliminate the need for pre-sized storm shutters. The interchangeable storm shutters are made up of individual panels slidably connected to one another. The panels may be extended to cover an exposed area of window. The storm shutters may be interlocked together in order to fit a particular window and may be held in place by brackets, quick tapping screws, or threaded rods and nuts that allow for quick installation and removal.

13 Claims, 4 Drawing Sheets

TELESCOPING HURRICANE SHUTTERS

BACKGROUND OF THE INVENTION

1. Field of Invention

This invention relates to removable hurricane storm shutters, to protect a window during a storm from wind and flying debris.

2. Description of Related Art

The use of storm shutters to protect a window during a storm is well known in the prior art. Typically, these shutters may consist of a precut portion of material such as plywood, attached to the outer frame of a window. These panels may be attached to the outer window frame by hinges, nails or screws, or by use of a bracket assembly mounted to the outer window frame allowing the storm shutter to be slid into place.

SUMMARY OF THE INVENTION

Hurricane storm shutters must be precut to fit individual windows. This requires that each window on a house be measured and a storm shutter cut to fit that particular window. Thus, these storm shutters are not interchangeable between windows of different sizes.

In addition, the process of cutting and measuring storm shutters to fit a window can take a considerable amount of time. This may be of particular concern to a home owner with little or no advanced warning of an approaching storm. In the case of plywood storm shutters that are attached by means of nails or screws, there is also the problem of damage to the outer window frame from repeatedly nailing or screwing the storm shutters into place. One method of expediting the process of putting storm shutters in place is the use of corrugated plastic shutters that are precut for each individual window. These shutters are held in place by means of brackets on the upper and lower portion of the window frame. This type of system facilitates the quick placement and removal of each shutter.

These plastic shutters are lightweight and easily stored. However, each shutter must be precut to match the dimensions of the particular window it is to cover. In the case where there is a limited amount of time to prepare a house for a storm, the time necessary to precut each shutter for each window may create a problem. Further, when each shutter has been precut for an individual window, the shutters must be sorted and matched to each window on the house prior to installation, thus consuming additional time that may be critical during the period prior to a storm.

This invention provides an apparatus and method for protecting a window during a storm using interchangeable storm shutters. The shutters used to protect a particular window are made up of a series of interlocking panel sections of a predetermined width. A first panel section would be placed in a window and a second panel section, slidably connected to the first panel section by a telescopic connection, would be extended along a longitudinal axis to the appropriate window height to cover an exposed area of the window. The next storm shutter also comprised of the first and second telescoping panel sections would be extended to the window height, put in place, and interlocked with the previously installed storm shutter. This process would continue until the entire exposed area of the window has been covered. Thus, the apparatus and method of this invention allows for the placement of interchangeable storm shutters in the windows of a house prior to a storm. Further, the apparatus and method of this invention reduce the time necessary to prepare a house for a storm, in that these shutters may be obtained and put in place without having to be precut for each individual window.

In addition, the storm shutters of the prior art typically do not allow light to pass through the window into the house. Thus, in the event of a power outage the occupants of the house may be in total darkness during a daytime storm. The apparatus and method of the current invention takes advantage of a translucent plastic material that would allow light to pass through the shutters and thus maintain illumination in the house during daylight hours in the event of a power outage. Lastly, the apparatus and method of this invention allow for easier removal and storage because the panel sections can be removed and stacked in a pile of a uniform dimension and without regard to the order or location of the windows from which they were removed.

These and other features and advantages of this invention are described in or are apparent from the following detailed description of the preferred embodiments.

BRIEF DESCRIPTION OF THE DRAWINGS

The invention will be described with reference to the accompanying drawings, in which like elements are labeled with like numbers and in which.

DETAILED DESCRIPTION OF PREFERRED EMBODIMENTS

Figure 1:
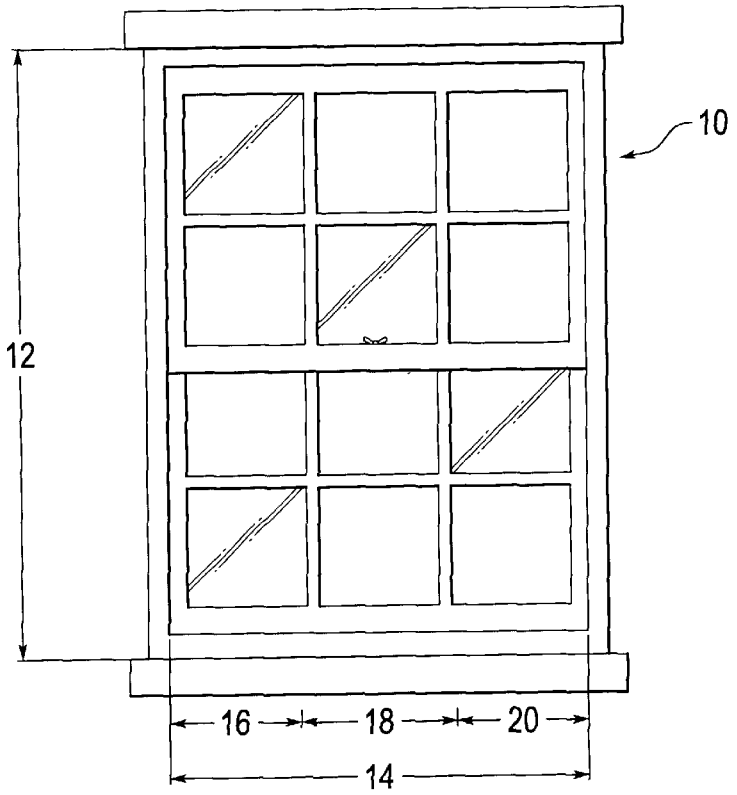
FIG. 1 shows an exemplary embodiment of a typical window which may be protected with storm shutters according to this invention.

FIG. 1 shows a typical window 10 that may be protected by the storm shutters of the present invention. The storm shutter is designed to protect the entire area of the window. The window 10 has a height 12 and a width 14 which can be divided into three window pane widths 16, 18 and 20. While one particular type of window is illustrated, the invention is applicable to any window of any size, shape and orientation.

Figure 2:
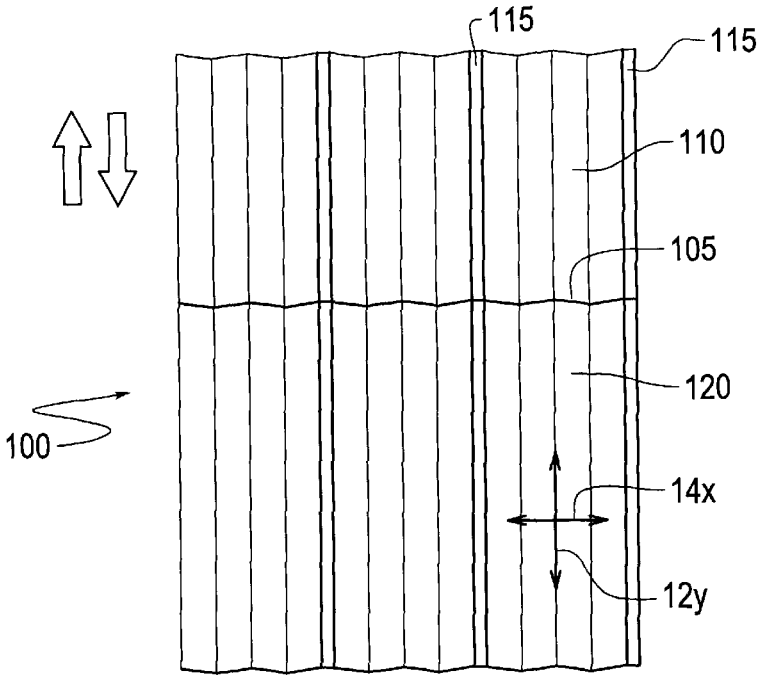
FIG. 2 is an exemplary embodiment of the storm shutters as fully assembled and prepared for installation on a window.

FIG. 2 is an exemplary embodiment of three storm shutters interlocked together. The first panel 120 is slidably connected to the second panel 110 to form the removable storm shutter 100. Each storm shutter 100 has two longitudinal edges. The first and second panels 120, 110 preferably are telescopically interconnected to allow extension of the second panel relative to the first panel to adjust the length of the storm shutter to the window height 12. The first and second panels 120, 110, preferably have a width that matches the window pane width 20. Those skilled in the art recognize that the width of the storm shutter may vary and is not limited to the window pane width. In addition, those skilled in the art recognize that the telescopic interconnection of the first and second panels results in an overlap of the first panel over the second panel (or vice versa), thus defining an overlap edge 105 between the first and second panels. While the invention has been described in terms of extending the length of the panels to cover the window vertical length 12, those skilled in the art appreciate that the panels can be extended horizontally to cover the width 14 of the window.

The first panel 120 and second panel 110 may be corrugated and may be of a translucent or transparent material such as a clear structural plastic. One such material is sold under the tradename Lexan™. Other structural materials, such as metal or wood, could be substituted. However, these may not achieve the advantage of allowing light through the shutters.

The first panel has a longitudinal axis 12*y* and transverse axis 14*x*. The second panel also has a longitudinal axis and transverse axis and is slidably connected to the first panel by a slidable connection for relative movement along one of the longitudinal axis and transverse axis. The second panel 110 may be fixed in relation to the first panel 120 at a predetermined interval by a retainer. The predetermined interval corresponds to an area of the window to be protected by the storm shutter.

Figure 3:
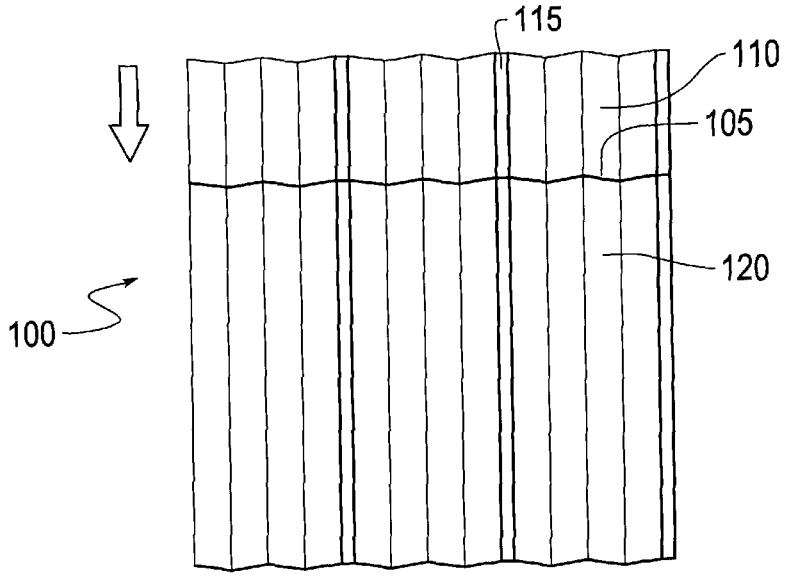
FIG. 3 is another exemplary embodiment of the storm shutters having the second panel partially extended.

FIG. 3 is an exemplary embodiment of the storm shutters of this invention having the second panel 110 slidably retracted in relation to the first panel 120. The second panel 110 may be slidably retracted or extended in relation to the first panel 120 to facilitate installation and removal in a window to be protected. The retraction or extension of the first panel 120 relative to the second panel 110 also allows the storm shutter to be adjusted to the of a differently sized window. In addition, the second panel 110 may be extended height of a differently sized window. In addition the second panel 110 may be extended to cover the top or bottom portion of a window. When the first 120 and second 110 panels are fully retracted such that the first 120 and second 110 panels completely overlap, they form a storm shutter of uniform size that can be easily stacked and stored. When needed for the next storm, any storm shutter can be extracted from the stock and adjusted in size to cover any window. Therefore, storm shutters of the invention need not be designated for a particular window.

In this embodiment, three storm shutters are interlocked together to form an integral unit to cover the area of one window. Each storm shutter 100 has two longitudinal edges 115. One edge or both edges 115 may interlock with an edge of an adjacent storm shutter. Those skilled in the art will appreciate that multiple storm shutters may be interlocked together to cover a window having any window width 14. In addition, those skilled in the art recognize that the first and second panels can be formed of a predetermined uniform size, and then assembled together to form a shutter, with adjacent shutters interlocked at their edges to cover a window of any size.

Figure 4:
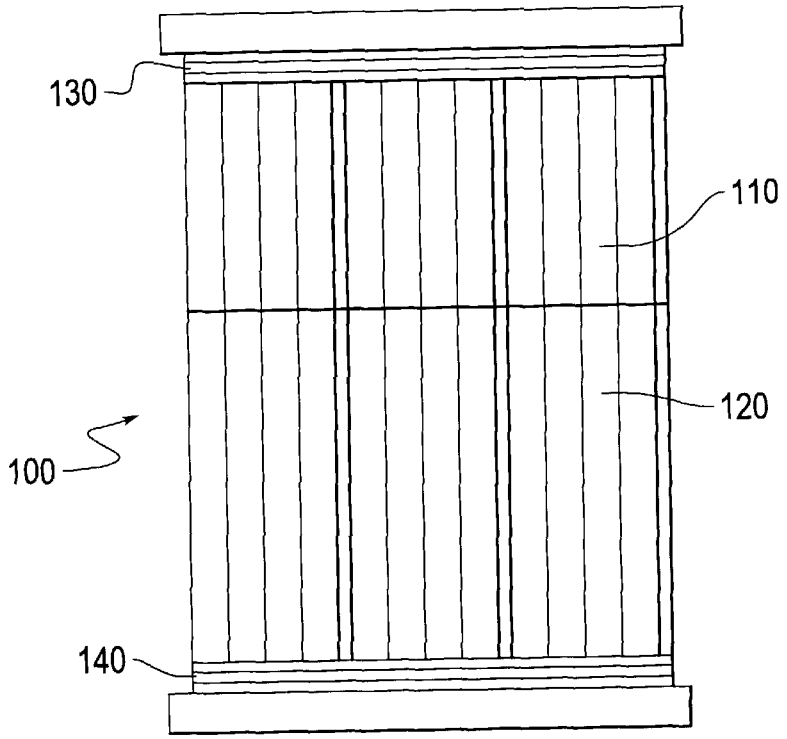
FIG. 4 is another exemplary embodiment of the storm shutters of this invention fully assembled and installed on a window.

FIG. 4 shows the exemplary storm shutters according to this invention installed in a typical window. Brackets 130 and 140 in the upper and lower window sills retain the interlocking storm shutters 100 in the window at the top and bottom portions. Other embodiments may utilize brackets to retain the shutters on the vertical sides of the windows. Still other embodiments may utilize brackets to retain the shutter on all four sides of the window. In addition to retaining the shutters in the window, brackets 130 and 140 facilitate the installation and removal of the individual shutters in the window by creating a tract for each shutter to slide into and out of place. The brackets 130 and 140 may be removably installed in the upper and lower portions of the outer frame of the window, or they may be permanently affixed in a manner that retains the aesthetic appearance of the window frame. The first and second panels 120 and 110 may be placed in the window brackets and extended slidably in relation to one another to fit in the window height, or they may be extended prior to placement in the window brackets 130 and 140. Other embodiments may use quick tapping screws, bolts, or threaded rods with wing nuts in lieu of brackets 130 and 140 to retain the inner locking storm shutters 100 in the window at the top and bottom portions, or on all four sides.

Figure 5:
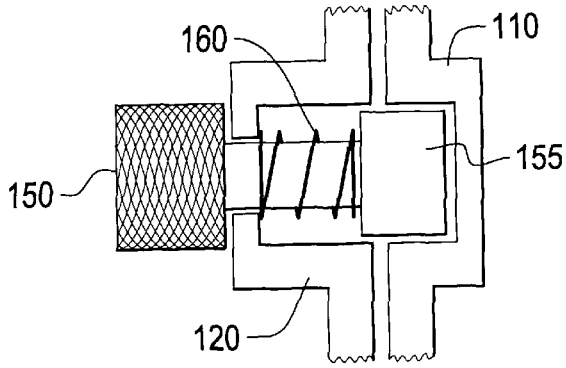
FIG. 5 is an exemplary embodiment of a fastener for locking the second panel in place in relation to the first panel.

FIG. 5 is an embodiment of a retainer for fixing the second panel 110 in relation to the first panel 120. The retainer has a plug 150 that is slidably mounted in a hole in the first panel 120. The panel 120 also contains a recess 155 in the vicinity of the hole for housing the end of the plug when the first panel 120 is moved laterally in relation to the second panel 110. The plug 150 engages a recess 155 in the second panel 110 at the location that corresponds to the overall length of the shutter as it is to be installed in the window. The plug 150 engages the recess 155 in the second panel 110 due to the force exerted by an urging member 160. This urging member 160 may be a helical spring or other such member capable of urging the plug 150 into the recess 155 of the second panel 110. To disengage the retainer, the plug 150 is moved in the opposite direction out of the recess 155 of the second panel 110, thus freeing the second panel 110 to move in relation to the first panel 120. While only one recess 155 is shown, several recesses may be aligned in a column and spaced at predetermined intervals to allow the first and second panels to be extended to any one of a plurality of lengths.

Figure 6:
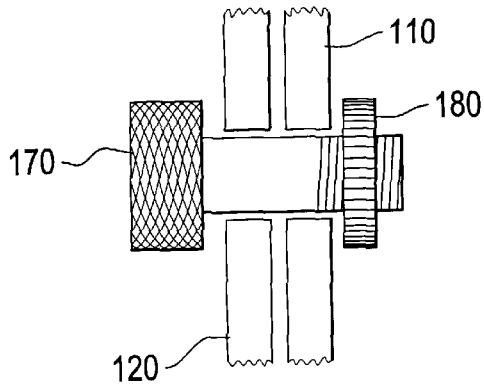
FIG. 6 is another exemplary embodiment of a fastener for locking the second panel in place in relation to the first panel.

FIG. 6 is another embodiment of a retainer to affix the second panel 110 in relation to the first panel 120. A bolt 170 inserts through a corresponding hole in the second panel 110 and the first panel 120. The bolt 170 is retained in place by a circular nut 180 that is threaded on to the bolt from the opposite side. The circular nut 180 has ridges on the outside peripheral edge to facilitate hand tightening and removal. The bolt 170 also has ridges to facilitate hand tightening and removal. When assembling the storm shutter, the first panel 120 and the second panel 110 would be adjusted to the proper height for placement in the window. The bolt 170 would then be placed through the corresponding hole in the first panel 120 and the second panel 110 exposing the threaded portion of the bolt 170 on the opposite end. The circular washer 180 would then be threaded on to the bolt, thus fixing the first panel 120 in relation to the second panel 110. This process would be reversed to disassemble the storm shutter. Several holes can be aligned in a column and spaced at predetermined intervals. Other embodiments may use wing nuts in place of the circular nut 180.

Other retainers are available for use in the invention. For example, one panel may include an integral projecting and flexible ratchet arm, which engages one of a plurality of recesses in the other panel. When the panels slide in the extension direction under a relatively weak pulling force, the ratchet arm bends to enter and exit each recess. However, in the retroaction direction, the ratchet arm abuts a wall of the recess thereby maintaining the extended length of the shutter. A relatively strong compressive force would be necessary to force the arm to bend and exit the recess, thereby allowing the shutter to retract in size.

Figure 7:
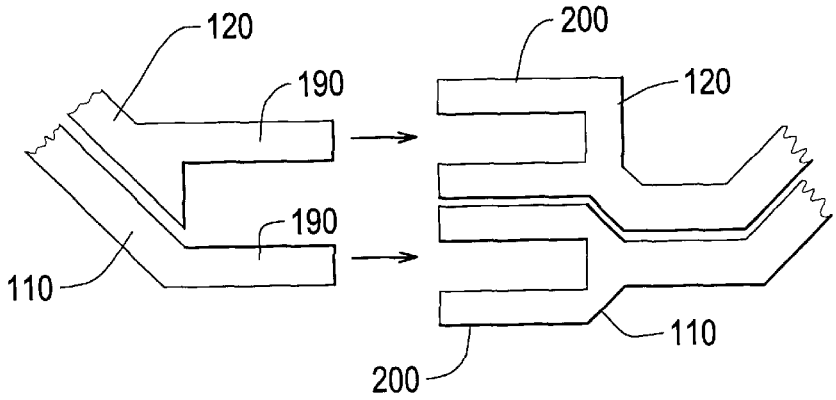
FIG. 7 is an embodiment of an interlocking mechanism for interlocking a first storm shutter with a second storm shutter.

FIG. 7 is an embodiment of an interlocking mechanism for joining two sections of a storm shutter together. A retaining channel 200 runs longitudinally on both the first panel 120 and the second panel 110. The channel 200 is an integral part of both the first panel 120 and the second panel 110. On the opposite end of the panels from the retaining channel 200 is a male connector 190 which also runs longitudinally on both the first panel 120 and the second panel 110. The male connector 190 is inserted in the retaining channel 200 to interlock two storm shutters together. The male connector 190 is retained in the retaining channel 200 with the assistance of an interference fit between the outer portion of the male connector 190 and the inner portion of the retaining channel 200. Other embodiments may utilize bolts and wing nuts fitted in corresponding holes in the male connector 190 and retaining channel 200 to retain two storm shutters in the interlocked position. The panel sections 110 and 120 may be interlocked together prior to being installed in the window or may be interlocked during installation by sliding successive storm shutters 100 into the retaining brackets and applying force to the opposite ends of the storm shutters 100. The storm shutters 100 may be taken apart by applying force in the opposite direction thus removing the male connector 190 from the retaining channel 200.

Figure 8:
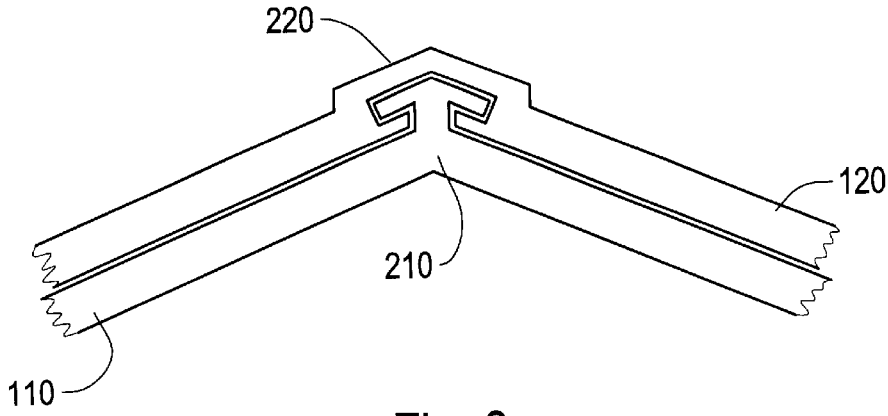
FIG. 8 is an embodiment of a slidable connection between the first panel and second panel of the storm shutters of this invention.

FIG. 8 is an embodiment of a slidable connection between the first panel 120 and the second panel 110. The slidable connection has a male connector 210 that is an integral part of the second panel 110 which fits into a retaining cavity 220 which is an integral part of the first panel 120. The male connector 210 runs longitudinally the full length of the second panel 110. The retaining cavity 220 also runs the full length of the first panel 120. The slidable connection operates such that the second panel 110 may be extended or retracted in relation to the first panel 120 while maintaining the structural integrity of the entire storm shutter 100. The slidable connection operates such that the second panel 110 may move freely longitudinally in relation to the first panel 120. In other embodiments this connection may be used repeatedly for additional panel sections such that they may extend telescopically to cover a designated window area. Further, the male connector 210 and the retaining cavity 220 may be placed at varying longitudinal locations on the panels 110 and 120.

Figure 9:
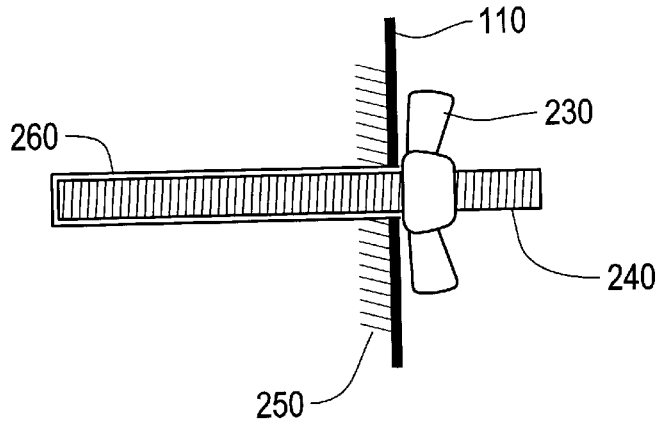
FIG. 9 is an exemplary embodiment of a threaded rod with a wing nut for securing the storm shutters of this invention to a typical window frame.

FIG. 9 is an embodiment of a threaded rod 240 that is installed in a window frame 250. The threaded rod 240 is maintained in the window frame 250 by an interference fit in the corresponding window frame hole 260. The threaded rod 240 may be permanently or removably affixed to the window frame 250. Once the threaded rod 240 is in place, the second panel 110 of the storm shutter of this invention is mounted on the threaded rod 240 through a retaining hole 280. The second panel 110 is then retained on the threaded rod 240 by a wing nut 230. This arrangement allows for the quick installation of the storm shutters of this invention without the use of brackets. When the storm shutters are to be removed the wing nut 230 is removed from the threaded rod 240 allowing the panel 110 to slide out of place. The threaded rod 240 may be removed or may be left in place in the window frame 250 for future use. Those skilled in the art will recognize that this embodiment may be used to retain the storm shutters of this invention at various locations on a window frame to facilitate a tight and secure fit over the entire window.

Figure 10:
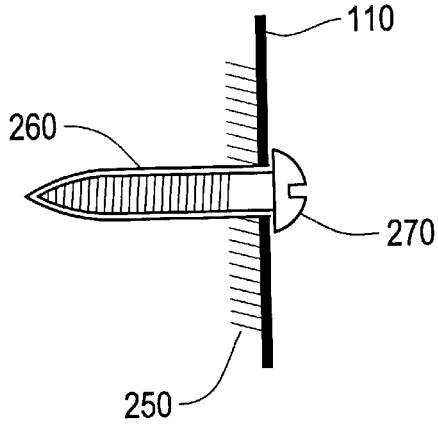
FIG. 10 is an embodiment of a self tapping screw which may be used to secure the storm shutters of this invention to a typical window frame.

FIG. 10 is an embodiment of a self tapping screw 270 used to retain the shutters of this invention on a window frame 250. The self tapping screw 270 is mounted through a retaining hole 280 and the panel 110 into the retaining hole 260 in the window frame 250. In this embodiment, the self tapping screw 270 must be removed completely from the window frame 250 in order to remove the storm shutters of this invention. The screw head 270 may be adapted for a common or Philips type screwdriver. In addition, the screw head 270 may be replaced by a hexagonal bolt head to facilitate installation with a wrench. One skilled in the art will recognize that this arrangement may be used to secure the storm shutters of this invention to a window frame at various locations to facilitate a tight and secure fit.

While this invention has been described in conjunction with specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of the invention.

What is claimed is:

1. A removable storm shutter for protecting at least a portion of a window, comprising:

a continuous first panel having a longitudinal axis and a transverse axis;

a continuous second panel having a size corresponding to a size of the first panel and having a longitudinal axis and a transverse axis, the second panel overlapping the first panel and being telescopically connected to the first panel by a slidable connection for relative movement of the first and second panels along one of the longitudinal axis and transverse axis to form the removable storm shutter to cover the portion of the window without gaps, the slidable connection connecting the first and second panels in a retracted position for stacking wherein the longitudinal and transverse axes of the first and second panels substantially overlap and an extended position wherein the second panel extends beyond the first panel in a direction of one of the longitudinal and transverse axes;

a first retainer that directly fixes the second panel to the first panel in the extended position at a predetermined interval corresponding to an area of the window to be protected by the storm shutter; and a second retainer disposed along longitudinal sides of the first and second panels that contiguously interlocks the first and second panels with an adjacent set of first and second panels to cover an adjacent section of the window without gaps.

2. The removable storm shutter according to claim 1, further comprising an interlocking mechanism for interlocking a side of the storm shutter with an adjoining side of an adjacent storm shutter covering an adjacent portion of the window.

3. The removable storm shutter according to claim 1, wherein the slidable connection between the first panel and the second panel is telescopic.

4. The removable storm shutter according to claim 1, wherein the first and second panels are corrugated.

5. The removable storm shutter according to claim 1, wherein the first and second panels are formed from a plastic material.

6. The removable storm shutter according to claim 1, wherein the first and second panels are formed from a translucent plastic material.

7. The removable storm shutter according to claim 1, wherein the storm shutter is retained in the window by a first bracket mounted on one side of the window and a second bracket mounted on the opposite side of the window.

8. The removable storm shutter according to claim 1, wherein the storm shutter is retainable on the window by a quick tapping screw mounted through a hole in the shutter onto a window frame.

9. The removable storm shutter according to claim 1, wherein the storm shutter is retainable on the window by a threaded rod mounted through a hole in the shutter on a window frame and held in place with a nut.

10. The removable storm shutter according to claim 1, wherein the retainer that fixes the second panel in relation to the first panel comprises a projecting member on one of the first and second panels that engages a corresponding recessed member on the other of the first and second panels.

11. The removable storm shutter according to claim 1, wherein the retainer that fixes the second panel in relation to the first panel comprises a peg inserted through corresponding holes in the first and second panels.

12. A method of installing storm shutters for protecting a window, comprising the steps of:

determining a length of an area of the window to be protected;

slidably telescopically connecting a continuous first panel to a continuous second panel to move the first and second panels between a retracted position for stacking wherein the first and second panels substantially overlap and an extended position wherein the second panel extends beyond the first panel to form the storm shutter to cover the portion of the window without gaps;

retaining the second panel in the extended position by directly attaching the first panel at a predetermined position corresponding to the length of the area of the window to be protected by the storm shutter; and contiguously interlocking the first and second panels with an adjacent set of first and second panels along a longitudinal side shared by the first and second panels and the adjacent first and second panels so at to cover an adjacent section of the window without gaps.

13. A removable and adjustable storm shutter for covering a section of a window by attaching the storm shutter to the window, the storm shutter comprising:

a continuous first rectangular panel;

a continuous second corresponding sized panel overlapping the first panel and being telescopically connected to the first panel by a slidable connection for adjusting a longitudinal length of the first and second continuous panels to form the storm shutter to cover the portion of the window without gaps, the slidable connection connecting the first and second continuous panels in a retracted position for stacking wherein the first and second panels substantially overlap and an extended position wherein the second panel extends beyond the first panel;

a first retainer that directly attaches the first panel to the second panel in the extended position to set the longitudinal length of the first and second panels so that the panels extend between upper and lower edges of the window and cover the section of the window behind the panels; and a second retainer disposed along longitudinal sides of the first and second panels that contiguously interlock the first and second panels with an adjacent set of first and second panels covering an adjacent section of the window.

* * * * *